United States Patent [19]

Kurita et al.

[11] Patent Number: 4,701,377

[45] **Date of Patent: * Oct. 20, 1987**

[54] POLYAMIDE FIBERS HAVING IMPROVED PROPERTIES, AND THEIR PRODUCTION

[75] Inventors: Kazuo Kurita, Ohtsu; Hideaki Ishihara, Uji, both of Japan

[73] Assignee: Toyo Boseki Kabushiki Kaisha, Japan

[ * ] Notice: The portion of the term of this patent subsequent to Mar. 12, 2002 has been disclaimed.

[21] Appl. No.: 831,376

[22] Filed: Feb. 20, 1986

[30] Foreign Application Priority Data

Feb. 20, 1985 [JP] Japan ..... 60-32218

[51] Int. Cl.[4] ..... D02G 3/00

[52] U.S. Cl. ..... 428/364; 264/210.7; 264/210.8

[58] Field of Search ..... 428/364; 264/103, 210.7, 264/210.8

[56] References Cited

U.S. PATENT DOCUMENTS

| | | | |
|---|---|---|---|
| 2,807,863 | 10/1957 | Schenker | 264/210.7 X |
| 3,090,997 | 5/1963 | Au | 264/210.7 |
| 3,091,015 | 5/1963 | Zimmerman | 264/210.7 X |
| 3,382,307 | 5/1968 | Ciceri et al. | 264/210.7 |
| 3,546,329 | 12/1970 | Hirono et al. | 264/210.7 X |
| 3,946,094 | 3/1976 | Kanetsuna et al. | 264/28 |
| 4,369,155 | 1/1983 | Schilo et al. | 264/103 |

*Primary Examiner*—Lorraine T. Kendell

*Attorney, Agent, or Firm*—Jones, Tullar & Cooper

[57] ABSTRACT

A polyamide fiber excellent in strength, which comprises at least one of polycapramide, polyhexamethylene adipamide and polytetramethylene adipamide in an amount of not less than 60% by weight on the basis of the polyamide fiber and which is characterized by having a relative viscosity of not less than 2.3 and less than 3.5 (measured on a 96% by weight sulfuric acid solution having a polyamide concentration of 10 mg/ml at 20° C.), an index of birefringence (Δn) (measured after 24 hours under the conditions of 30° C. and 80% relative humidity) of not less than $55\times10^{-3}$ and a tenacity of not less than 12.0 g/d, the index of birefringence in section satisfying the following relationship:

$$\Delta n_A - \Delta n_B \geqq 0$$

(wherein $\Delta n_A$ is the index of birefringence of fiber at the position of $r/R=0.9$, $\Delta n_B$ is the index of birefringence of fiber at the position of $r/R=0.0$, R is the radius of the fiber section and r is the distance from the central axis of the fiber section) and the tenacity and the break elongation satisfying the following relationship:

$$\text{Tenacity} \times (\text{Break elongation})^{\frac{1}{2}} \geqq 46.0\ g/d \cdot \sqrt{\%}\ .$$

8 Claims, 4 Drawing Figures

POLYAMIDE FIBERS HAVING IMPROVED PROPERTIES, AND THEIR PRODUCTION

CROSS-REFERENCE TO RELATED APPLICATIONS

This application discloses subject matter in common with applications, Ser. Nos. 464,089, 415,773 and 615,619, now U.S. Pat. Nos. 4,496,630, 4,504,545 and 4,624,816, respectively.

The present invention relates to polyamide fibers having improved properties, and their production. More particularly, it relates to polyamide fibers having high strength and being useful for reinforcement of rubber products, and their production.

For manufacture of polyamide fibers of high strength, it was proposed to spin a polyamide having a relative viscosity of not less than about 3.5 under certain specific conditions (Japanese Patent Publication (unexamined) No. 132109/83). It was also proposed to draw the filaments of a polyamide having a relative viscosity of less than about 3.5 by a certain specific procedure so as to make the degree of orientation of the drawn filaments at the outer layer lower than that at the inner layer with production of the micro structure highly oriented in the fiber direction (Japanese Patent Publication (unexamined) No. 136823/83). Additionally, there were proposed a method wherein a polyamide of high molecular weight as produced by solid phase polymerization is spun and drawn under conventional conditions (Japanese Patent Publication (unexamined) Nos. 199812/84 and 9209/84), a method wherein polyamide filaments are subjected to zone drawing (Japanese Patent Publication (unexamined) Nos. 15430/81, 130337/84 and 130338/84), etc.

However, these conventional methods have some drawbacks. For instance, the methods are disclosed in Japanese Patent Publication (unexamined) Nos. 132109/83, 199812/84 and 9209/84 require the use of a polyamide of high molecular weight, and their production needs a troublesome polymerization step. Particularly when the polymerization is effected in a solid phase, one additional step is necessitated in the manufacture so that the product cost is increased. Even when the polymerization is effected in a melt state, the recovery of the produced polymer from the reactor is not easy due to its high velocity. Further, the spinning conditions are quite restricted as disclosed in Japanese Patent Publication (unexamined) No. 132109/83.

In case of the manufacture of high strength fibers with a polyamide of usual molecular weight as disclosed in Japanese Patent Publication (unexamined) No. 136823/83, it is necessary to make the degree of orientation of the drawn filaments at the outer layer lower than that at the inner layer and prevent co-fusion of the multi-filaments. This requires careful and troublesome operations. The zone drawing as taught in Japanese Patent Publication (unexamined) Nos. 15430/81, 130337/84 and 130338/84 is industrially disadvantageous in that the draw speed is too low.

As the result of an extensive study to manufacture polyamide fibers of high strength from a polyamide having a relative viscosity of less than about 3.5, it has now been found that polyamide fibers having such a high tenacity as 12.0 g/d or more are obtainable by spinning and drawing under certain specific conditions. This invention is based on such finding.

According to the present invention, there is provided a polyamide fiber excellent in strength, which is characterized by having a relative viscosity of not less than 2.3 and less than 3.5 (measured on a 96% by weight sulfuric acid solution having a polyamide concentration of 10 mg/ml at 20° C.), an index of birefringence ($\Delta n$) (measured after 24 hours under the conditions of 30° C. and 80% relative humidity) of not less than $55\times10^{-3}$ and a tenacity of not less than 12.0 g/d, the index of birefringence in section satisfying the following relationship:

$$\Delta n_A - \Delta n_B \geqq 0$$

(wherein $\Delta n_A$ is the index of birefringence at the position of $r/R=0.9$, $\Delta n_B$ is the index of birefringence at the position of $r/R=0.0$, R is the radius of the section and r is the distance from the central axis of the section) and the tenacity and the break elongation satisfying the following relationship:

$$\text{Tenacity} \times (\text{Break elongation})^{\frac{1}{2}} \geqq 46.0\ g/d \cdot \sqrt{\%}\ .$$

The polyamide fiber of the invention is characterized in being manufactured by the use of a polyamide having a molecular weight within the usual range, i.e. a relative viscosity of not less than 2.3 and less than 3.5, having a usual distribution of degree of orientation, i.e. the orientation degree at the outer layer being equal to or larger than that at the inner layer, and showing an index of birefringence of not less than $55\times10^{-3}$, a tenacity of not less than 12 g/d and a tenacity x (break elongation)$^{\frac{1}{2}}$ of not less than 46.0 g/d.$\sqrt{\%}$). In fact, the polyamide fiber of the invention is characterized in being made of a polyamide having a comparatively small relative viscosity, having a highly stretched structure of the molecular chain while retaining a normal distribution of degree of orientation in section and showing a high tenacity. Advantageously, the fiber can be manufactured with high productivity.

For manufacture of the polyamide fiber of the invention, there is used as a polyamide having a relative viscosity of not less than 2.3, particularly of not less than 2.8 and less than 3.5, when measured on a 96% sulfuric acid solution having a polymer concentration of 10 mg/ml at 20° C. When the relative viscosity is less than 2.3, it is difficult to attain a high tenacity of 12 g/d or more. Even if such high tenacity is attained, the characteristic value of tenacity x (break elongation)$^{\frac{1}{2}}\geqq46.0$ will not be satisfied. When the relative viscosity is 3.5 or more, the melt viscosity is markedly increased so that the productivity is much lowered.

Specific examples of the polyamide are polycaprolactam, polyhexamethylene adipamide, polyhexamethylene sebacamide, polytetramethylene adipamide, etc. Copolymers comprising the monomeric components in said specific polyamides as the major constituents (e.g. not less than 50% by weight) with or without other monomeric components, condensation products of diamines such as 1,4-cyclohexane bis(methylamine) and linear aliphatic dicarboxylic acids, etc. are also usable. While any particular limitation is not present on the kind of the polyamide usable, the presence of one or more chosen from poly-ε-capramide, polyhexamethylene adipamide and polytetramethylene adipamide in an amount of not less than 60% by weight based on the total polymer content of the fiber is favorable.

The polyamide may be optionally incorporated with conventional additives such as luster-preventing agents, pigments, light stabilizers, heat stabilizers, oxidation inhibitors, antistatic agents, dyeing improvers and adhesion improvers, insofar as such additives do not produce any unfavorable influence. Particularly when the polyamide fiber is to be employed for industrial uses, the incorporation of oxidation inhibitors is favorable for imparting thereto sufficient resistance to heat, light, oxygen, etc. Examples of the oxidation inhibitros are copper salts (e.g. copper acetate, cuprous chloride, cupric chloride, cuprous bromide, cupric bromide, cuprous iodide, copper phthalate, copper stearate), complexes of copper salts with organic compounds (e.g. 8-oxyquinoline copper complex, 2-mercaptobenzimidazole copper complex), etc. Preferred are cuprous iodide, copper acetate, 2-mercaptobenzimidazole-cuprous iodide complex, etc. Other examples are alkali metal or alkaline earth metal halides (e.g. potassium iodide, potassium bromide, potassium chloride, sodium iodide, sodium bromide, zinc chloride, calcium chloride), organic halides (e.g. pentaiodobenzene, hexabromobenzene, tetraiodoterephthalic acid, methylene iodide, tributylethylammonium iodide), organic or inorganic phosphorus compounds (e.g. sodium pyrrophosphate, sodium phosphite, triphenyl phosphite, 9,10-dihydro-10-(3',5'-di-t-butyl-4'-hydroxybenzyl)-9-oxaperphosphaphenanthrene-10-oxide), phenolic antioxidants (e.g. tetrakis[methylene-3-(3,5-di-t-butyl-4-hydroxyphenyl)propionate]methane, 1,3,5-trimethyl-2,4,6-tris(3,5-di-t-butyl-4-hydroxybenzyl)benzene, n-octadecyl-3-(3,5-di-t-butyl-4-hydroxyphenyl)propionate, diethyl 4-hydroxy-3,5-di-t-butylbenzylphosphate), amine antioxidants (e.g. N,N'-di-beta-naphthyl-p-phenylene diamine, 2-mercaptobenzimidazole, phenyl-beta-naphthylamine, N,N'-diphenyl-p-phenylene diamine), condensates of diphenylamine with arylketones, etc. Among them, potassium iodide, 2-mercaptobenzimidazole, etc. are favorable. Usually, incorporation of these oxidation inhibitors is accomplished by adding them to the polymerization system for production of the polyamide or admixing them with the polyamide in chips. The content of the oxidation inhibitor in the polyamide may be normally about 1% by weight or less. For instance, the copper salt as the oxidation inhibitor may be contained in an amount of 10 to 300 ppm, preferably of 50 to 200 ppm. Further, for instance, other oxidation hihibitors may be contained in an amount of about 0.01 to 1% by weight, favorably of about 0.03 to 0.5% by weight. When desired, two or more oxidation inhibitors may be employed in combination; particularly preferred is the combined use of copper salts with other oxidation inhibitors.

According to the process of the invention, the polyamide optionally incorporated with any additives is spun in a melt state through a spinning orifice by a per se conventional procedure.

The spun filaments are introduced into a cooling zone under the spinning orifice. The space between the spinning orifice and the cooling zone is preferably sealed with a heated inert gas (of which the temperature is usually in the vicinity of the temperature of the spinning orifice), whereby the unevenness of the filaments in physical properties can be efficiently prevented and the filaments of low degree of orientation are obtainable with ease. Such sealing is also effective in prevention of staining at the nozzle so that the continuous operation of spinning without breakage becomes possible over a long period of time. As the inert gas, there is normally used steam, nitrogen gas, carbon dioxide gas or the like. In view of the safety and/or the cost, steam is the most preferred.

It is usually preferred to apply an oiling agent to the filaments after cooling. As the oiling agent, the use of a non-aqueous oiling agent is favored. This is because a non-aqueous oiling agent makes the temperature elevation efficiency of the filaments higher than an aqueous oiling agent.

The resultant filaments are taken up under such condition as making the index of birefringence to $13\times10^{-3}$ or less, preferably to $7\times10^{-3}$ or less. Such condition can be readily attained by controlling the take-up speed appropriately. When the index of birefringence is more than $13\times10^{-3}$, the drawing property is lowered and the drawn state becomes unstable.

The filaments as taken up are then subjected to drawing. The filaments as taken up may be subjected immediately and continuously to drawing. Alternatively, the filaments may be once rolled up and then subjected to drawing.

The drawing comprises the steps of (a) transferring the undrawn filaments onto a first supply roller and then a second supply roller with application of a pre-draft of less than 20% between said first supply roller and said second supply roller, (b) transferring the resultant pre-drafted filaments onto a first draw roller kept at a temperature of not lower than 100° C. while jetting super-heated steam of not lower than 200° C. from a jet nozzle provided between the second supply roller the first draw roller onto the pre-drafted filaments so as to achieve a first drawing of not less than 50% based on the total draw ratio and (c) transferring the resulting drawn filaments onto a second draw roller kept at a temperature of not lower than 150° C. while passing through a heating zone provided between the first draw roller and the second draw roller with such a temperature gradient as having a higher temperature elevating capability of the drawn filaments at the exit than that at the entrance to achieve a second drawing.

In step (a), the undrawn filaments are transferred from the first supply roller to the second supply roller, during which a pre-draft of less than 20% is applied thereto, whereby the filaments are arranged to make the running state on the supply rollers even. When the pre-draft is not applied, the uniform arrangement of the filaments is hardly maintained so that the stability on the drawing can not be assured. When the pre-draft is applied in 20% or more, the filaments are apt to cause deformation, and the drawing is unstabilized.

In the step (b), the thus pre-drafted and arranged filaments are transferred from the second supply roller to the first draw roller heated at a temperature of higher than 100° C., during which super-heated steam of 200° C. or more is jetted thereto from a jet nozzle between the second supply roller and the first draw roller, whereby the first drawing is effected in not less than 50% of the total draw ratio. The temperature of the second draw roller is required to be controlled so as not to cause the post-elongation of the filaments whereby the running state is unstabilized. Thus, the second supply roller is to be kept at a temperature of less than 100° C., usually from 30° to 80° C.

By effecting the first drawing of the filaments between the second supply roller and the first draw roller while jetting super-heated steam thereto, neck drawing is realized twice, i.e. at the exit of the second supply roller and with super-heated steam. Especially when the heating at the exit of the second supply roller is carried out by the use of a nip roller, the filaments are nipped with heating so that a higher draw ratio can be attained in the first drawing to attain a higher strength. Favorably, the nip roller is kept at a temperature of 10° to 30° C. higher than the temperature of the second supply roller and provided in such a manner that the predrafted filaments at the exit of the second supply roller is nipped thereby. As a result of the first drawing, the filaments are drawn in not less than 50% of the total draw ratio to obtain drawn filaments of not less than 40% in break elongation.

In step (c), the thus obtained drawn filaments are transferred from the first draw roller kept at a temperature of not lower than 100° C. to the second draw roller kept at a temperature of not lower than 150° C. Between these two draw rollers, a non-contact heater is provided to give a temperature gradient, i.e. to make the filament temperature elevating capability higher at the exit side than at the entrance side, whereby the second drawing is effected.

The first draw roller is required to be set at a temperature of not lower than 100° C., preferably between 130° and 200° C. When the temperature is lower than 100° C., sufficient deformation of the filaments does not occur so that a high total draw ratio can not be attained. When the temperature is higher than 200° C., the second drawing is unstabilized.

The heater is to be so adjusted that the capability for elevating the temperature of the filaments is higher at the exit than at the entrance. The temperature gradient may be continuously or stepwise higher from the entrance to the exit. For a stepwise gradient, for instance, the heater may be divided into two parts, i.e. the former half and the latter half, the temperature of the former half being lower than that of the latter half. Further, the former half may be made with a non-contact heater, and the latter half may be made with an inert gas as heated. However, it is not necessarily required to keep the apparent temperature of the latter half higher than that of the former half, because the capability for elevating the temperature of the filaments does not necessarily correspond to the temperature of the heating means itself. For instance, an inert gas have a remarkably higher heat capacity than a slit heater depending upon the kind and the flow amount. As the inert gas, there may be used steam, nitrogen, carbon dioxide, etc., among which steam is the most preferred.

As result of the second drawing, neck-like drawing occurs twice, i.e. at the exit of the first draw roller and in the temperature gradient heater.

The heater is required to be so adjusted that the atmospheric temperature around the entrance of the filaments is higher than the temperature of the first draw roller and the atmospheric temperature around the exit of the filaments is not lower than 200° C. When the atmospheric temperature around the exist is lower than 200° C., the neck drawing in the heating zone does not occur.

When the temperature of the second draw roller is lower than 150° C., the heat set effect is not produced, and the second drawing becomes unstabilized. When the temperature of the second draw roller is higher than the melting point of the filaments, the breakage of the filaments will be produced on the second draw roller. Even if not, the filaments are adhered or flattened, whereby the physical properties of the filaments are much deteriorated. Accordingly, the temperature of the second draw roller should be kept at a temperature of not lower than 150° C., preferably not lower than 170° C., but not higher than the melting point of the filaments. The total draw ratio of the filaments throughout the first drawing step and the second drawing step may be usually from about 5.5 to 10.

The resultant drawn filaments wherein the molecular chain is highly extended are then subjected to relaxation under heating. This relaxation may be accomplished, for instance, by the use of a relax roller. By the relaxation, the arrangement of the molecular chain is made uniform so that the produced fibers can be enhanced in initial modulus with increase of the size stability. The relaxation percentage is necessary to be from 3 to 15%. When it is less than 3%, the relaxation effect is not produced. When it is more than 15%, the strength is more or less lowered. The provision of a heater between the second draw roller and the relax roller is effective in enhancement of the physical properties by relaxation.

The temperature of the relax roller is to be not less than 120° C. and less than the melting point of the filaments. When the temperature is less than 120° C., the relaxation can not be accomplished within a short period of time.

The thus obtained fiber has the characteristic properties as above defined. It has an index of birefringence of not less than $55\times10^{-3}$, from which it may be understood that the molecular chain is highly extended. In comparison with conventional high strength polyamide fibers having a long period of 90 Å in small angle X-ray diffraction, it is characteristic in having a much larger long period, i.e. not less than 100 Å. This fact also shows that the molecular chain is greatly extended. Further, the polyamide fiber of the invention shows an apparent crystal size ($ACS_{0140}$) of more than 50 Å in the lengthwise direction, whereas that of the conventional high strength polyamide fibers is 40 Å or so. Accordingly, it is understood that the growth of crystals in the polyamide fiber of the invention is particularly prominent in the lengthwise direction so that the molecular chain in the lengthwise direction is greatly extended.

The high strength polyamide fiber of the invention is favored to have a monofilament denier of not more than 60 denier. When the monofilament denier is over 60 denier, it becomes difficult to accomplish high elongation of the molecular chain so that the tenacity can not be made above 12 g/d. A smaller monofilament denier makes it possible to attain a higher elongation of the molecular chain. In case of the monofilament denier being too small, however, the stability of spinning cannot be assured. In general, the monofilament denier of the polyamide fiber according to the invention is preferred to be not more than 10 denier and not less than 0.5 denier.

The fiber of the invention may be employed for various uses, particularly as the reinforcing material for rubber products. When employed as the rubber reinforcing material, it is normally used in a multi-filament state. However, this is not limitative, and the fiber may be used in any other state such as robing yarn, staple fiber or chopped strand. The fiber of the invention is suitably employed as tire cords, particularly carcass cords in radial structure tires for heavy weight vehicles and as rubber reinforcing cords in V belts, flat belts, toothed belts, etc. Further, the fibers may be employed as threads, ribbons, ropes, cloths, etc.

The methods for measurement of various parameters as hereinabove and hereinafter referred to are explained below.

(1) Measurement of the relative viscosity (RV):

A polyamide was dissolved in conc. sulfuric acid (96.3±0.1% by weight) to make a concentration of 10 mg/ml. The falling time of 20 ml of the resulting solution ($T_1$; second) was measured at a temperature of 20±0.05° C. by the use of an Ostwald viscosimeter of 6 to 7 seconds in water falling time. Using the same viscosimeter as above, the falling time of conc. sulfuric acid as used above ($T_0$; second) was also measured. The relative viscosity (RV) was calculated acording to the following equation:

$$RV = T_1/T_0.$$

(2) Measurement of the index of birefringence (Δn):

Measurement was effected by the use of a Nikon polarization microscope (POH type) with a compensator manufactured by Reiz. As the light source, an apparatus for spectrum light source ("SLS-8-B type"; Na source) manufactured by Toshiba was used. A specimen allowed to stand at a constant temperature of 20° C. and a relative humidity of 65% for 24 hours was cut at an angle of 45° to the fiber axis of 5 to 6 cm long and placed on a slide glass. The slide glass was placed on a rotatable stand, and the stand was rotated so as to make an angle of 45° between the specimen and the polarizer. An analyzer was inserted to make a dark field, the compensator was adjusted to 30, and the number of fringe patterns (n) was counted. The compensator was rotated clockwise and the scale (a) at which the specimen first became darkest was read. Then, the compensator was rotated counterclockwise, and the scale (b) at which the specimen first became darkest was read. The compensator was returned to 30, the analyzer was taken off, and the diameter of the specimen (d) was measured. The index of birefringence (Δn) was calculated according to the following equation (average of 20 measured values):

$$\Delta n = \tau/d(\tau(\text{retardation}) = n^{\lambda}{}_{o} + \epsilon)$$

$$\lambda_o = 589.3 \text{ m}\mu$$

where ε is obtained from C/10,000 and i in the Reiz's explanation sheet of the compensator, i being a−b (i.e. the difference in readings of the compensator).

(3) Measurement of the distribution of Δn in section:

From the refractive index at the center (n⊥, O and n ||, O) and the refractive index at the outer layer (n⊥, 0.9 and n ||, 0.9) measured by the use of an interference-polarization microscope, the specific molecular orientation of the fiber of the invention is made clear, and the relationship between the fiber and its excellent strength can be shown. According to the interference band method using an interference-polarization microscope manufactured by Jena, the distribution of the average refractive index observed from the side of the fiber can be measured. This method is applicable to the fiber having a circular section. The refractive index of the fiber can be characterized by the refractive index (n ||) to the polarization vibrating in prallel to the fiber axis and the refractive index (n⊥) to the polarization vibrating vertically to the fiber axis. Measurements as hereinafter explained are all carried out with the refractive indexes (n || and n⊥) obtained by the use of a xenon lamp as the light source and a green color beam of an interference filter wavelength of 544 mμ under polarization.

Illustrating the measurement of n || as well as n ||, 0 and n ||, 0.9 obtainable from n ||, the fiber is immersed in a sealing agent having a refractive index ($n_E$) which will produce a gap of the interference band within a wavelength of 0.2 to 1 and being inert to the fiber by the use of a slide glass and a cover glass which are optically flat. The refractive index of the sealing agent ($n_E$) indicates the value measured by the use of an Abbe refractometer with a green color beam (wavelength, λ=544 mμ) at 20° C. The sealing agent may be, for instance, a mixture of liquid paraffin and alpha-bromonaphthalene having a refractive index of 1.48 to 1.65. A monofilament of the fiber is immersed in the sealing agent, and the pattern of the interference band is photographed. The resulting photograph is expanded 1,000 to 2,000 times and subjected to analysis.

Figure 1A:
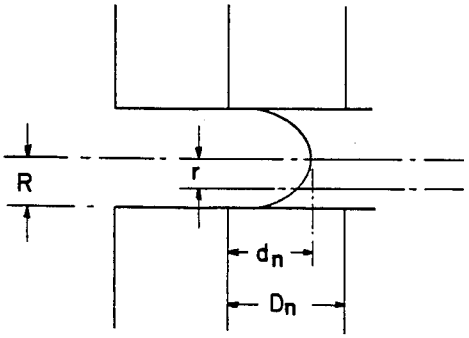
FIG. 1(A) shows parallel interference bands, the gap produced by the specimen of FIG. 1(B), and the light path difference in the gap.
Figure 1B:
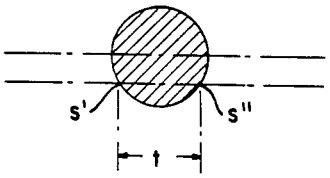
FIG. 1(B) shows the fiber in cross section which produced the gap of FIG. 1(A).

As shown in FIG. 1 of the accompanying drawings, the light path difference (L) can be represented by the following equation:

$$L = \frac{d_n}{D_n}\lambda = (n// - n_E)t$$

wherein $n_E$ is the refractive index of the sealing agent, n is the average refractive index between S' and S'' of the fiber, t is the thickness between S' and S'', λ is the wavelength of the used beam, $D_n$ is the distance of the paralleled interference bands of the background (corresponding to 1λ) and $d_n$ is the gap of the interference band due to the fiber.

The pattern of interference bands as shown in FIG. 1 is evaluated using two kinds of the sealing agents having the following refractive indexes ($n_1$, $n_2$):

$$n_s < n_1$$

$$n_s > n_2$$

wherein $n_s$ is the refractive index of the specimen. Thus, the light path differences ($L_1$, $L_2$) in the case of using the sealing agents having the refractive indexes $n_1$, $n_2$ are representable by the following equations:

$$L_1 = \frac{d_1}{D_1}\lambda = (n// - n_1)t$$

$$L_2 = \frac{d_2}{D_2}\lambda = (n// - n_2)t$$

$$n = \frac{L_1 n_2 - L_2 n_1}{L_1 - L_2}$$

Accordingly, the distribution of the average refractive index (n ||) of the fiber in various positions from the center to the outer layer of the fiber can be calculated from the light path difference at those positions according to the above equation. The thickness (t) may be calculated on the assumption that the fiber as obtained has a circular section. Due to any variation of the conditions on the manufacture or any accident after the manufacture, the fiber may have any non-circular section. In order to avoid the inconvenience caused by such section, measurement should be made for the parts where the gap of the interference band is symmetric to the fiber axis. Measurement is effected with intervals of 0.1 R between 0 and 0.9 R, R being the radius of the fiber, and the average refractive index at each position is obtained.

Likewise, the distribution of n⊥ is obtainable.

Therefore, the distribution of the index of birefringence may be calculated according to the following equation:

$$\Delta n(r/R) = n\,||,\ r/R - n\perp, r/R$$

The value Δn(r/R) indicates an average on at least three filaments, preferably 5 to 10 filaments.

Figure 2A:
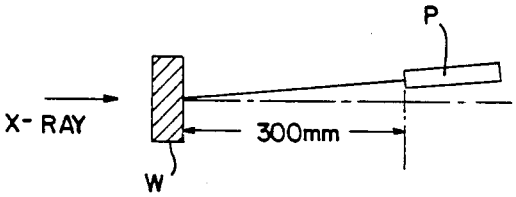
Figure 2B:
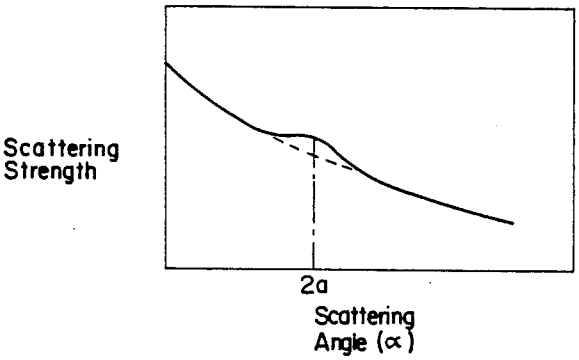

FIG. 2(A) illustrates x-rays being applied to a specimen to measure the small angle x-ray scattering pattern by a diffractometer; and FIG. 2(B) shows a plot of scattering strength v. scattering angle which indicates the diffraction strength.

(4) Measurement of the fiber long period by small angle X-ray diffraction:

Measurement of the small angle X-ray scattering pattern was effected by the use of an X-ray generator (Model RU-3H) manufactured by Rigaku Denki. The conditions on measurement were as follows: tube voltage, 45 KV; tube current, 70 mA; copper target; CuK monochromatized with a nickel filter ($\lambda x = 1.5418$ Å). A specimen was provided on a sample holder so as to keep the monofilaments in parallel. A suitable thickness of the specimen was 0.5 to 1.0 mm. X-rays were applied to the fibers vertically to the fiber axis arranged in parallel, and the difractometer provided with a proportional counter probe (SPC-20) (P) manufactured by Rigaku Denki at a distance of 300 mm from the specimen (W) was rotated with an angle rotation speed of 2 sec/min to measure the diffraction strength curve. From the peak position or shoulder position of the diffraction strength curve, the long period small angle scattering angle ($2\alpha$) was read off, and the fiber long period (d) was calculated according to the following equation (cf. FIGS. 2(A) and (B)):

$$d = \frac{\lambda x \alpha}{2\ \mathrm{Sin}}$$

$$\lambda x = 1.5418\ (\text{Å})$$

When measurement according to the above procedure was difficult, the small angle X-ray scattering photograph was taken, and the fiber long period was calculated according to the above equation.

(5) Measurement of the strength-elongation characteristics:

Using a tensilon tester ("UTM-4L type") manufactured by Toyo-Baldwin, measurement was made on a specimen, which was allowed to stand at a constant temperature of 20° C. and a relative humidity of 65% for 24 hours, under the conditions of a specimen length (gauge length) of 20 mm and a pulling speed of 20 cm/min. The initial modulus was calculated from the maximum inclination around the original point of the S-S curve. On calculation of each of the above characteristic values, the average one obtained from measurement for at least 5 filaments, preferably for 10 to 20 filaments, was used.

(6) Dry heat shrinkage:

A specimen in hank was allowed to stand at a constant temperature of 20° C. under a relative humidity of 65% for 24 hours. Then, the length ($l_0$) of the specimen when charged with a load corresponding to 0.1 g/d was measured. The specimen was allowed to stand with no tension in an oven of 150° C. for 30 minutes and again at a constant temperature of 20° C. under a relative humidity of 65% for 4 hours. The length ($l_1$) of the specimen when charged with the same load as above was measured. The dry heat shrinkage (SHD) of the specimen was calculated according to the following equation:

$$SHD = \frac{l_0 - l_1}{l_0} \times 100\ (\%)$$

(7) Monofilament denier:

Measured according to JIS L1073 (1977).

(8) Specific gravity:

A density inclination tube comprising toluene and carbon tetrachloride was prepared, and a sufficiently defoamed specimen was admitted in the tube kept at a temperature of 30°+0.1° C. After allowed to stand for 5 hours, the position of the specimen in the tube was read off by the aid of the scale on the tube. The resulting value was calculated in terms of the specific gravity by the aid of a calibration curve between the scale of the inclincation tube and the specific gravity. Measurement was made at n=4. The specific gravity was read off down to the fourth decimal place.

(9) Heat stress peak temperature with constant length and temperature elevation:

Under the conditions of a specimen length of 4.5 cm, a temperature elevation speed of 20° C./min. and an initial load of 0.05 g/d, the heat shrinkage stress from room temperature to the melt cutting temperature was measured, and the temperature at which the heat stress was maximum was determined (cf. Textile Research Journal, Vol. 47, page 732 (1977)).

(10) Apparent crystal size (ACS):

The apparent crystal size was calculated from the half width at the diffractive strength of the plane (0140) of the equatorial diffractive curve in the wide angle X-ray diffractive pattern according to Scherrer's equation:

$$ACS = \frac{0.9\lambda}{\sqrt{B^2 - \alpha^2 \cos\theta}}$$

wherein λ is an X-ray wavelength (1.5418 Å), B is a half width (rad), α is a corrected angle ($6.98 \times 10^{-3}$ rad) and is a diffractive angle (°).

The X-ray used in the Examples of the invention has a tube electric voltage of 45 KV, a tube current of 70 mA, a copper counter-negative electrode, a Ni filter and a wavelength of 1.5418 Å. As the diffractometer, a goniometer of SG-7 type manufactured by Rigaku Denki was used, and as the X-rays producing apparatus, a rotarflex of RU-3H type was used.

Practical and presently preferred embodiments of the invention are illustratively shown in the following examples wherein part(s) and (%) are by weight unless otherwise indicated.

EXAMPLES 1 TO 32 AND COMPARATIVE EXAMPLES 1 TO 41

A polyamide having a relative viscosity as shown in Table 1 was spun under the conditions as shown in Table 1 to make filaments, of hich the index of birein-fringence (Δn) is shown in Table 1.

The obtained filaments were subjected to stretching under the conditions as shown in Table 2 to give the stretched fibers having the properties as shown in Table 3.

TABLE 1

(E: Example; C: Comparative)

| | | E-1 | C-1 | C-2 | E-2 | E-3 | C-3 | E-4 | E-5 | E-6 | C-4 |
|---|---|---|---|---|---|---|---|---|---|---|---|
| Polyamide | Kind(*1) | PCA | PCA | PCA | PCA | PCA | PCA | PCA | PCA | PCA | PCA |
| | Relative viscosity | 3.4 | 3.4 | 3.4 | 3.4 | 3.4 | 3.4 | 3.4 | 3.4 | 3.4 | 3.4 |
| Spinning condition | Temperature (°) | 290 | 290 | 290 | 290 | 290 | 290 | 290 | 290 | 290 | 290 |
| | Diameter of nozzle hole (mm) | 0.30 | 0.30 | 0.30 | 0.30 | 0.30 | 0.40 | 0.20 | 0.50 | 0.55 | 0.60 |
| | Number of nozzle | 204 | 204 | 204 | 204 | 304 | 304 | 408 | 51 | 30 | 16 |
| | Injected amount per nozzle (g/min) | 160 | 160 | 160 | 160 | 160 | 195 | 160 | 160 | 160 | 160 |
| | Distance between nozzle surfaceface and top of quenching zone (mm) | 150 | 300 | 300 | 150 | 150 | 150 | 150 | 150 | 150 | 150 |
| | Heating cylinder(*2) between nozzle and quenching zone | O | O | X | O | O | O | O | O | O | O |
| | Sealing with inser gas(*3) | O | X | X | O | O | O | O | O | O | O |
| | Kind of inert gas | $N_2$ | — | — | $N_2$ | $N_2$ | $N_2$ | $N_2$ | $N_2$ | $N_2$ | $N_2$ |
| | Temperature (°C.) | 290 | — | — | 290 | 290 | 290 | 290 | 290 | 290 | 290 |
| | Atmospheric temperature between nozzle and quenching zone (°C.) | 290 | 260 | 190 | 290 | 290 | 290 | 290 | 290 | 290 | 290 |
| | Wind velocity for quenching (m/sec) | 0.30 | 0.30 | 0.30 | 0.30 | 0.30 | 0.30 | 0.30 | 0.30 | 0.30 | 0.30 |
| | Spinning oil | | | | | | | | | | |
| | Type of spinning oil(*4) | N | N | N | A | N | N | N | N | N | N |
| | Amount (%) | 0.8 | 0.8 | 0.8 | 0.8 | 0.8 | 0.8 | 0.8 | 0.8 | 0.8 | 0.8 |
| | Take-up speed (m/min) | 250 | 250 | 250 | 250 | 250 | 400 | 250 | 250 | 250 | 250 |
| Condition of spinning(*6) | | S | U | S | S | S | U | S | S | S | S |
| n of unstretched filament ($\times 10^{-3}$) | | 5.0 | 5.0 | 15.0 | 5.0 | 10.0 | 17.0 | 3.0 | 7.5 | 7.0 | 4.5 |
| Remarks | | | | | | | | | | | |

| | | E-7 | E-8 | C-5 | C-6 | C-7 | C-8 | E-9 | E-10 | C-9 |
|---|---|---|---|---|---|---|---|---|---|---|
| Polyamide | Kind(*1) | PCA | PCA | PCA | PCA | PCA | PCA | PHA | PTA | PCA |
| | Relative viscosity | 3.0 | 2.5 | 2.1 | 4.1 | 4.1 | 3.8 | 3.2 | 3.4 | 3.4 |
| Spinning condition | Temperature (°) | 280 | 270 | 270 | 300 | 280 | 300 | 300 | 300 | 290 |
| | Diameter of nozzle hole (mm) | 0.30 | 0.30 | 0.30 | 0.30 | 0.30 | 0.30 | 0.30 | 0.30 | 0.20 |
| | Number of nozzle | 204 | 204 | 204 | 204 | 64 | 204 | 204 | 204 | 408 |
| | Injected amount per nozzle (g/min) | 160 | 160 | 160 | 160 | 20 | 45 | 160 | 160 | 160 |
| | Distance between nozzle surfaceface and top of quenching zone (mm) | 150 | 150 | 100 | 150 | 300 | 150 | 150 | 150 | 300 |
| | Heating cylinder(*2) between nozzle and quenching zone | O | O | O | O | O | O | O | O | O |
| | Sealing with inser gas(*3) | O | O | O | O | X | O | O | O | X |
| | Kind of inert gas | $N_2$ | $N_2$ | $N_2$ | $N_2$ | — | $N_2$ | Steam | $N_2$ | — |
| | Temperature (°C.) | 280 | 270 | 270 | 300 | — | 300 | 300 | 300 | — |
| | Atmospheric temperature between nozzle and quenching zone (°C.) | 280 | 270 | 270 | 300 | 200 | 300 | 300 | 300 | 290 |
| | Wind velocity for quenching (m/sec) | 0.30 | 0.30 | 0.30 | 0.30 | 0.30 | 0.30 | 0.30 | 0.30 | 0.30 |
| | Spinning oil | | | | | | | | | |
| | Type of spinning oil(*4) | N | N | N | N | N | N | N | N | N |
| | Amount (%) | 0.8 | 0.8 | 0.8 | 0.8 | 0.8 | 0.8 | 0.8 | 0.8 | 0.8 |
| | Take-up speed (m/min) | 250 | 250 | 250 | —(*5) | 20 | 70 | 250 | 250 | 250 |
| Condition of spinning(*6) | | S | S | S | U | S | S | S | S | U |
| n of unstretched filament ($\times 10^{-3}$) | | 4.0 | 3.0 | 2.0 | — | 7.9 | 5.2 | 4.8 | 6.2 | — |
| Remarks | | | | | (*7) | | | | | (*7) |

Note:
(*1)PCA: polycapramide; PHA: polyhexamethylene adipamide; PTA: polytetramethylene adipamide.
(*2)O: heating cylinder equipped; X: heating cylinder not equipped.
(*3)O: sealing effected; X: sealing not effected.
(*4)N: spinning oil of non-aqueous type; A: spinning oil of aqueous type.
(*5)taking-up impossible.
(*6)S: stable; U: unstable.
(*7)Stretching impossible.

TABLE 2

(E: Example; C: Comparative)

| | E-11 | C-10 | E-12 | C-11 | C-12 | C-13 | C-14 | C-15 | C-16 | E-13 |
|---|---|---|---|---|---|---|---|---|---|---|
| Process(*1) | DD | DD | DD | DD | DD | DD | DD | DD | DD | DD |
| Spinning | | | | | | | | | | |
| Speed of 1st(*2) take-up roller | * | * | * | * | * | * | * | * | * | * |
| Pre-draft (time) | 1.10 | 1.10 | 1.10 | 1.10 | 1.10 | 1.10 | 1.25 | 1.10 | 1.10 | 1.10 |
| Temperature of 2nd take-up roller (°C.) | 50 | 100 | 50 | 50 | 50 | 50 | 50 | 50 | 50 | 50 |
| Heated nip roll(*3) | X | X | O | X | X | X | X | X | X | X |
| Temperature (°C.) | — | — | 70 | — | — | — | — | — | — | — |
| Jet steam nozzle(*4) | O | O | O | X | O | O | O | O | O | O |
| Temperature (°C.) | 300 | 300 | 300 | — | 300 | 300 | 300 | 150 | 300 | 300 |
| Stretching | | | | | | | | | | |
| 1st draw roller Speed (m/min) Temperature (°C.) | 150 | 150 | 150 | 150 | 150 | 150 | 150 | 150 | rp(*5) | 210 |
| Slit heater(*6) | O | O | O | O | O | X | O | O | O | O |
| Temperature(*7) gradient | O | O | O | O | X | — | O | O | O | O |
| Former half | slit | slit | slit | slit | slit | — | slit | slit | slit | slit |
| Temperature (°C.) | 240 | 240 | 240 | 240 | 240 | — | 240 | 240 | 240 | 240 |
| Length (mm) | 1000 | 1000 | 1000 | 1000 | 1000 | — | 1000 | 1000 | 1000 | 1000 |
| Latter half | slit | slit | slit | slit | slit | — | slit | slit | slit | slit |
| Temperature (°C.) | 400 | 400 | 400 | 400 | 240 | — | 400 | 400 | 400 | 400 |
| Length (mm) | 1000 | 1000 | 1000 | 1000 | 1000 | — | 1000 | 1000 | 1000 | 1000 |
| 2nd draw roller Speed (m/min) Temperature (°C.) | 180 | 180 | 180 | 180 | 180 | 180 | 180 | 180 | 180 | 180 |
| Relax roller | | | | | | | | | | |
| Rate of relaxation (%) | 5 | 5 | 5 | 5 | 5 | 5 | 5 | 5 | 5 | 5 |
| Temperature (°C.) | 150 | 150 | 150 | 150 | 150 | 150 | 150 | 150 | 150 | 150 |

| | E-14 | C-17 | E-15 | C-18 | C-19 | C-20 | C-21 | E-16 | E-22 |
|---|---|---|---|---|---|---|---|---|---|
| Process(*1) | DD | DD | DD | DD | DD | DD | DD | OFF | DD |
| Spinning | | | | | | | | | |
| Speed of 1st(*2) take-up roller | * | * | * | * | * | * | * | * | * |
| Pre-draft (time) | 1.10 | 1.10 | 1.10 | 1.10 | 1.10 | 1.10 | 1.10 | 1.10 | 1.06 |
| Temperature of 2nd take-up roller (°C.) | 50 | 50 | 50 | 50 | 50 | 50 | 50 | 50 | 50 |
| Heated nip roll(*3) | X | X | X | X | X | X | X | O | X |
| Temperature (°C.) | — | — | — | — | — | — | — | 70 | — |
| Jet steam nozzle(*4) | O | O | O | O | O | O | O | O | X |
| Temperature (°C.) | 300 | 300 | 300 | 300 | 300 | 300 | 300 | 300 | — |
| Stretching | | | | | | | | | |
| 1st draw roller Speed (m/min) Temperature (°C.) | 150 | 150 | 150 | 150 | 150 | 150 | 150 | 150 | 150 |
| Slit heater(*6) | O | O | O | O | O | O | O | O | X |
| Temperature(*7) gradient | O | O | O | O | O | O | O | O | — |
| Former half | slit | slit | slit | slit | slit | slit | slit | slit | — |
| Temperature (°C.) | 180 | 130 | 240 | 240 | 240 | 240 | 240 | 240 | — |
| Length (mm) | 1000 | 1000 | 1000 | 1000 | 1000 | 1000 | 1000 | 1000 | — |
| Latter half | slit | slit | steam | slit | slit | slit | steam | slit | — |
| Temperature (°C.) | 400 | 400 | 280 | 400 | 400 | 4000 | 400 | 280 | — |
| Length (mm) | 1000 | 1000 | 600 | 1000 | 1000 | 1000 | 1000 | 600 | — |
| 2nd draw roller Speed (m/min) Temperature (°C.) | 180 | 180 | 180 | 240 | 120 | 180 | 180 | 180 | 180 |
| Relax roller | | | | | | | | | |
| Rate of relaxation (%) | 5 | 5 | 5 | 5 | 5 | 0 | 20 | 5 | 5 |
| Temperature (°C.) | 150 | 150 | 150 | 150 | 150 | 150 | 150 | 150 | 150 |

Note:
(*1)DD: sequential spinning and stretching; OFF: intermittent spinning and stretching.
(*2)Speed of take-up roller corresponds to that of spinning.
(*3)O: provided; X: not provided.
(*4)O: provided; X: not provided.
(*5)room temperature.
(*6)O: provided; X: not provided.
(*7)O: provided; X: not provided.

TABLE 3

| | Spinning effected as in | Stretching effected as in | First draw ratio ($DR_1$) (time) | Total draw ratio (TDR) (time) | Physical characteristics I | II | III | IV | V | VI | VII | VIII | IX | X | XI |
|---|---|---|---|---|---|---|---|---|---|---|---|---|---|---|---|
| E-17 | E-1 | E-11 | 3.57 | 6.23 | 980 | 12.7 | 15.5 | 50.0 | 61.0 | 10.5 | 110 | 3.2 | 55.2 | 3.41 | 4.8 |
| C-23*1 | E-1 | C-10 | — | — | — | — | — | — | — | — | — | — | — | — | — |
| E-18 | E-1 | E-12 | 3.61 | 6.38 | 955 | 13.1 | 15.3 | 51.2 | 63.1 | 10.7 | 122 | 3.1 | 55.7 | 3.40 | 4.7 |
| C-24 | E-1 | C-11 | 4.10 | 5.35 | 1140 | 10.8 | 19.5 | 47.7 | 55.6 | 10.1 | 93 | 1.5 | 45.6 | 3.40 | 5.6 |
| C-25 | E-1 | C-12 | 3.57 | 5.75 | 1060 | 11.7 | 15.8 | 46.5 | 60.5 | 10.5 | 102 | 2.5 | 48.5 | 3.43 | 5.2 |
| C-26 | E-1 | C-13 | 3.57 | 5.20 | 1173 | 10.5 | 20.3 | 47.3 | 59.6 | 12.5 | 92 | 1.0 | 44.5 | 3.40 | 5.8 |
| C-27*2 | E-1 | C-14 | — | — | — | — | — | — | — | — | — | — | — | — | — |
| C-28 | E-1 | C-15 | 4.10 | 5.60 | 1090 | 11.3 | 18.1 | 48.1 | 60.0 | 10.7 | 100 | 1.3 | 46.5 | 3.41 | 5.3 |
| C-29 | E-1 | C-16 | 3.10 | 5.81 | 1050 | 11.6 | 16.3 | 46.8 | 60.3 | 10.9 | 101 | −1.5 | 47.0 | 3.40 | 5.1 |
| E-19 | E-1 | E-13 | 3.57 | 6.08 | 1005 | 12.4 | 16.0 | 49.6 | 60.8 | 10.0 | 108 | 2.3 | 54.3 | 3.43 | 4.9 |
| E-20 | E-1 | E-14 | 3.57 | 6.14 | 990 | 12.5 | 15.7 | 49.5 | 61.1 | 11.1 | 110 | 1.8 | 55.3 | 3.41 | 4.9 |
| C-30 | E-1 | C-17 | 3.57 | 5.77 | 1056 | 11.8 | 15.5 | 46.8 | 60.7 | 11.5 | 108 | 1.2 | 54.0 | 3.40 | 5.2 |
| E-21 | E-1 | E-15 | 3.57 | 6.48 | 940 | 13.2 | 15.7 | 52.3 | 63.4 | 10.3 | 125 | 1.9 | 58.2 | 3.43 | 4.6 |
| C-31*3 | E-1 | C-18 | 3.57 | — | — | — | — | — | — | — | — | — | — | — | — |
| C-32 | E-1 | C-19 | 3.57 | 5.91 | 1040 | 11.9 | 16.1 | 47.7 | 61.0 | 12.5 | 101 | 1.0 | 54.0 | 3.40 | 5.1 |
| C-33 | E-3 | C-20 | 3.37 | 5.81 | 1057 | 11.7 | 14.7 | 44.9 | 58.3 | 12.3 | 100 | 1.1 | 53.0 | 3.41 | 3.5 |
| C-34 | E-3 | C-21 | 3.73 | 5.62 | 1290 | 11.3 | 19.5 | 49.9 | 59.1 | 8.5 | 95 | 0.8 | 51.0 | 3.40 | 4.2 |
| C-35 | E-1 | C-22 | 4.10 | 5.15 | 1190 | 9.7 | 22.0 | 45.5 | 53.0 | 9.8 | 91 | 1.0 | 43.5 | 3.40 | 5.8 |
| E-22 | E-1 | E-16 | 3.43 | 6.05 | 1010 | 12.3 | 16.1 | 49.4 | 62.7 | 10.3 | 121 | 3.5 | 57.1 | 3.40 | 5.0 |
| C-36 | C-2 | E-11 | 2.95 | 4.83 | 1265 | 9.0 | 26.0 | 46.0 | 52.1 | 10.5 | 87 | 1.3 | 41.0 | 3.35 | 6.2 |
| E-23 | E-2 | E-11 | 3.47 | 6.12 | 998 | 12.5 | 16.0 | 50.0 | 62.7 | 10.0 | 118 | 2.0 | 56.3 | 3.40 | 4.9 |
| E-24 | E-3 | E-12 | 3.37 | 5.97 | 1023 | 12.1 | 15.7 | 47.9 | 61.3 | 10.3 | 110 | 2.3 | 55.6 | 3.40 | 5.0 |
| C-37 | C-3 | E-11 | 2.32 | 4.53 | 1350 | 8.3 | 27.0 | 43.1 | 51.0 | 9.5 | 85 | 4.1 | 41.0 | 3.41 | 4.4 |
| E-25 | E-4 | E-11 | 3.63 | 6.41 | 960 | 13.3 | 15.2 | 51.9 | 63.1 | 11.0 | 125 | 3.8 | 54.0 | 3.37 | 2.4 |
| E-26 | E-4 | E-12 | 3.85 | 6.74 | 915 | 14.5 | 14.3 | 54.8 | 64.0 | 11.2 | 130 | 3.5 | 56.5 | 3.35 | 2.2 |
| E-27 | E-5 | E-12 | 3.45 | 6.12 | 1008 | 12.3 | 15.3 | 48.1 | 62.0 | 12.5 | 115 | 4.8 | 55.3 | 3.37 | 19.8 |
| E-28 | E-6 | E-12 | 3.40 | 5.97 | 1033 | 12.0 | 15.1 | 46.6 | 61.0 | 12.7 | 110 | 5.9 | 54.7 | 3.34 | 34.3 |
| C-38 | C-4 | E-12 | 3.53 | 5.10 | 1210 | 11.0 | 14.7 | 42.2 | 57.0 | 13.1 | 101 | 7.5 | 51.3 | 3.31 | 75.6 |
| E-29 | E-7 | E-11 | 3.60 | 6.24 | 978 | 12.7 | 14.1 | 47.7 | 63.7 | 11.6 | 113 | 3.0 | 56.3 | 2.83 | 4.8 |
| E-30 | E-8 | E-11 | 3.63 | 6.27 | 974 | 12.8 | 13.5 | 47.0 | 62.2 | 12.1 | 111 | 2.7 | 54.1 | 2.41 | 4.8 |
| C-39 | C-5 | E-11 | 3.71 | 6.31 | 968 | 12.5 | 12.0 | 43.3 | 61.5 | 13.5 | 108 | 1.3 | 53.2 | 2.21 | 4.7 |
| C-40 | C-7 | E-14 | 3.42 | 6.01 | 1580 | 12.8 | 18.2 | 54.6 | 62.0 | 12.5 | 113 | 5.1 | 52.3 | 3.87 | 24.7 |
| C-41 | C-8 | E-11 | 3.74 | 6.20 | 1060 | 12.9 | 15.5 | 50.8 | 60.5 | 10.9 | 115 | 2.5 | 53.1 | 3.65 | 5.2 |
| E-31 | E-9 | E-12 | 3.63 | 6.41 | 950 | 13.1 | 15.0 | 50.7 | 62.3 | 7.3 | 118 | 1.5 | — | 3.33 | 4.7 |
| E-32 | E-10 | E-12 | 3.47 | 6.15 | 993 | 12.2 | 14.7 | 46.8 | 61.0 | 2.3 | 108 | 3.1 | — | 3.31 | 4.9 |

(E: Example; C: Comparative)
Note:
*1Physical characteristics:
I: Total filament denier (D)
II: Tenacity (DT, g/d)
III: Elongation at break (DE, %)
IV: $DT\sqrt{DE}$ (g/d $\sqrt{\%}$ )
V: Index of birefringence ($\Delta_n$)
VI: Dry heat shrinkage (SHD, %)
VII: Fiber long period (LP, Å)
VIII: $\Delta_n A - \Delta_n B$ ($\delta\Delta_n$)
IX: Apparent crystal size ($ACS_{0140}$) (A)
X: Relative viscosity
XI: Monofilament denier (d)
*2Stretching interrupted due to frequent occurrences of wrapping on the 2nd take-up roller.
*3Stretching interrupted due to frequent occurrences of wrapping on the 1st take-up roller and breakage of fibers.
*4Stretching interrupted due to melt-fusion on the 2nd roller.

What is claimed is:

1. A polyamide fiber excellent in strength, comprising at least one of polycapramide, polyhexamethylene adipamide and polytetramethylene adipamide in an amount not less than 60% by weight on the basis of the polyamide fiber, having a relative viscosity of not less than 2.3 and less than 3.5, measured on a 96% by weight sulfuric acid solution having a polyamide concentration of 10 mg/ml at 20° C., an index of birefringence (Δn), measured after 24 hours under the conditions of 30° C. and 80% relative humidity of not less than $55\times10^{-3}$, and a tenacity of not less than 12.0 g/d, the index of birefringence in section of the fiber satisfying the following relationship:

$$\Delta n_A - \Delta n_B \geqq 0$$

wherein $\Delta n_A$ is the index of birefringence of the fiber at the position of $r/R=0.9$, $\Delta n_B$ is the index of birefringence of the fiber at the position of $r/R=0.0$, R is the radius of the fiber section, and the tenacity and the break elongation satisfying the following relationship.

$$\text{Tenacity} \times (\text{Break elongation})^{\frac{1}{2}} \geqq 46.0\ g/d \cdot \sqrt{\%}\ .$$

2. The polyamide fiber according to claim 1, which comprises polycapramide in an amount of not less than 60% by weight of the basis of the polyamide fiber.

3. The polyamide fiber according to claim 1, which comprises polyhexamethylene adipamide in an amount of not less than 60% by weight on the basis of the polyamide fiber.

4. The polyamide fiber according to claim 1, which comprises polytetramethylene adipamide in an amount of not less than 60% by weight on the basis of the polyamide fiber.

5. The polyamide fiber according to claim 1, wherein a fiber long period spacing value at length by small angle X-ray diffraction is not less than 100 Å.

6. The polyamide fiber according to claim 1, of which the apparent crystal size (ACS) at the plane (0140) obtainable by a broad angle X-ray diffraction is not less than 50 Å.

7. The polyamide fiber according to claim 1, wherein the relative viscosity is not less than 2.8 and less than 3.5.

8. The polyamide fiber according to claim 1, wherein the fiber has a denier of not more than 60 denier.

* * * * *